United States Patent [19]

Campbell

[11] 3,989,443

[45] Nov. 2, 1976

[54] MULTIPLE FUEL BURNER AND USAGE IN ROTARY KILNS

[75] Inventor: William C. Campbell, Redlands, Calif.

[73] Assignee: California Portland Cement Company, Los Angeles, Calif.

[22] Filed: Oct. 10, 1975

[21] Appl. No.: 621,463

[52] U.S. Cl. ..... 431/8; 110/22 A; 431/174; 431/284; 431/285

[51] Int. Cl.[2] ..... F23C 1/00

[58] Field of Search ..... 431/174 X, 278, 284 X, 431/285 X, 2, 8; 110/22 R, 22 A X

[56] References Cited

UNITED STATES PATENTS

| | | | |
|---|---|---|---|
| 2,267,025 | 12/1941 | Grindle | 431/174 |
| 2,624,562 | 1/1953 | Tayler | 110/22 R |
| 3,147,795 | 9/1964 | Livingston et al. | 110/22 A |
| 3,217,779 | 11/1965 | Reed et al. | 431/285 |
| 3,302,596 | 2/1967 | Zinn | 110/22 R |
| 3,894,834 | 7/1975 | Estes | 431/174 |

*Primary Examiner*—Edward G. Favors
*Attorney, Agent, or Firm*—William W. Haefliger

[57] ABSTRACT

A multiple fuel burner assembly, especially suited for use in kilns, includes:

a. a forwardly elongated inner duct to deliver pulverized solid fuel to a burning zone beyond the end of the duct, b. multiple pipes spaced about the inner duct and opening generally forwardly to deliver fluid fuel to said zone beyond the ends of said pipes, and c. air delivery structure located outwardly of said inner duct and oriented to deliver air to the fuel delivered from said pipes and inner duct to said zone for combusting said fuel.

18 Claims, 7 Drawing Figures

MULTIPLE FUEL BURNER AND USAGE IN ROTARY KILNS

BACKGROUND OF THE INVENTION

This invention relates generally to burners for use in kilns, and more particularly concerns a combination burner operable with selected solid, liquid and gaseous fuels and particularly useful in rotary cement kilns.

Prior combination fuel burners have employed fluid delivery nozzles or outlets within solid fuel burners, primarily to produce heat. Such burners do not always assure complete combustion of the fuel when used within cement kilns, where a rich primary air stream may not always be present. Also, the flame structures produced by such burners are not best suited to the raw mix calcination processes and functions required by rotary cement kilns. These problems become increasingly critical for present day large production cement kilns, wherein large quantities of fuel must be burned.

SUMMARY OF THE INVENTION

It is a major object of the invention to provide a combination burner for solid, liquid and gaseous fuel, which overcomes the above as well as other problems, and is especially suited for use in rotary cement kilns. Basically, the combination burner includes a forwardly elongated inner or central duct to deliver pulverized solid fuel (such as coal or coke) to a burning zone located beyond the end of the duct; multiple pipes or nozzles spaced about the inner duct and opening generally forwardly to deliver fluid fuel to the burning zone; and air delivery structure located outwardly of the inner duct and oriented to deliver ambient or preheated air to the burning zone for combusting the fuel. Typically, the air delivery structure may comprise a forwardly elongated outer duct extending about the inner duct to form an air passing annulus or annular chamber within which or adjacent which at least three fluid fuel pipes extend forwardly; also, air flow controlling shutters may be associated with the annular chamber, and refractory material may closely surround the outer duct for protecting the burner against high temperatures from within the rotary cement kiln.

Further, there are preferably at least two or more fluid fuel delivery pipes arranged in satellite relation about the solid fuel delivery duct, and such pipes may include liquid fuel delivery pipes located within gaseous fuel delivery pipes, for optimum combustion control, as will appear. Thus, for example, ignition of the solid fuel delivered to the burning zone may be achieved by combustion of fluid fuel delivered from the satellite pipes.

These and other objects and advantages of the invention, as well as the details of an illustrative embodiment, will be more fully understood from the following description and drawings, in which:

DRAWING DESCRIPTION

DETAILED DESCRIPTION

Figure 7:
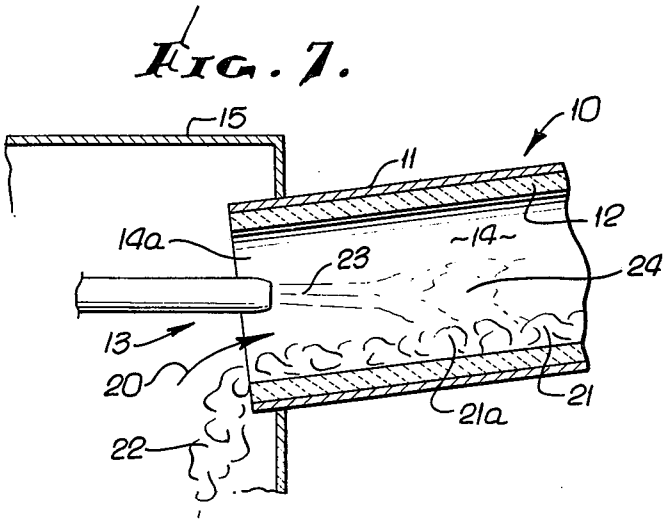
FIG. 7 is a vertical section through the burner end portion of a rotary cement kiln.

Referring first to FIG. 7, a tubular rotary cement kiln 10 includes a cylindrical metallic shell 11 and refractory lining 12. A burner assembly 12 projects into the lower open end portion 14*a* of the kiln interior 14, there being a hood 15 surrounding that open end. Air streams 20 enter the kiln after having been heated by clinker in a recuperative cooler, not shown, to aid fuel combustion and the reactions occurring in the kiln. The clinker 22 is formed from the raw mix 21 in exothermic reaction zone 21*a*, and then falls from the kiln, as shown. See in this regard U.S. Pat. No. 3,091,443 to Herz. Fuel from the burner is discharged into the kiln at 23 to mix with the hot air and combust in flame zone 24.

Extending the description to FIGS. 1–6, the combination burner includes a forwardly elongated metallic (stainless steel) inner duct 26 for delivering pulverized solid fuel, such as coal or coke, to the burning zone located beyond the forward end 26*a* of the duct. A single deflector 27 may extend transversely and horizontally across the interior of the duct forward end portion to deflect some solid fuel particles at an upward angle indicated at $\alpha$. The pulverized fuel is delivered at 127 to the inlet end 28 of the duct, as for example entrained within an air stream from a blower 29, the latter taking suction at 30 from the hot air within the coal or coke grinding mill. Pulverized fuel is introduced at 31. Other suitable fuel entrainment means may be employed. The blower is shut down if and when it is desired to burn fluid fuel, or it can be throttled to low volume for cooling of the inner duct 26.

The burner assembly also includes air delivery structure located outwardly of the inner duct and oriented to deliver air forwardly to the burning zone for cooling the burner and for combusting the fuel. That structure may, with unusual advantages, comprise a forwardly elongated stainless steel outer duct 32 extending concentrically about the inner duct 26 to form therewith an air passing annulus or air chamber 33. Cooling or heated combustion air may be supplied at 34 to the annulus 33 as ambient air, with draft created by the negative pressure conditions in the kiln, or from a blower indicated at 35, which may draw preheated air from the recuperative cooler or any other source. Shutters 36 at the entrance to the annulus may be suitably adjusted to control the rate of forward air flow within the annulus, and indicated at 37. Air discharging forwardly from the annulus at 38 mixes with the forwardly conveyed fuel (solid, liquid or gaseous) to support combustion thereof.

Figure 3:
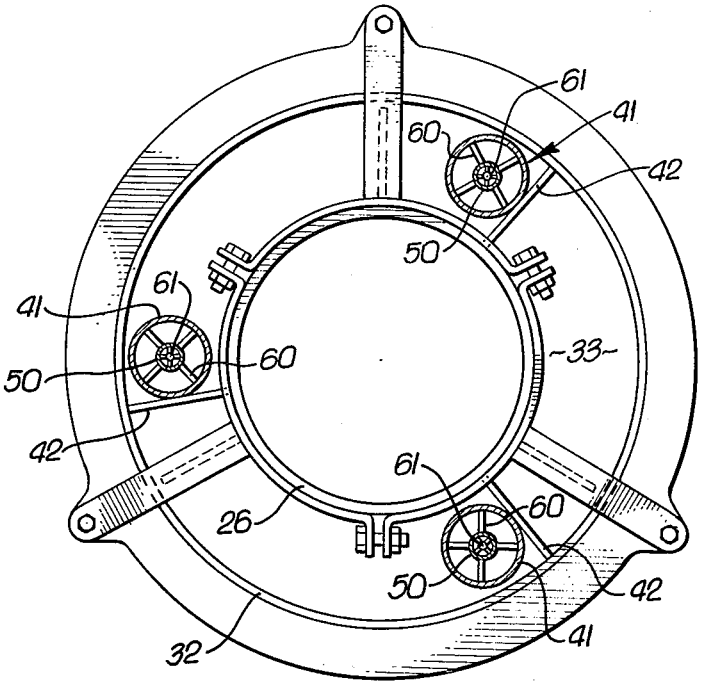
FIG. 3 is an end elevation, partly in section, on lines 3—3 of FIG. 1.
Figure 4:
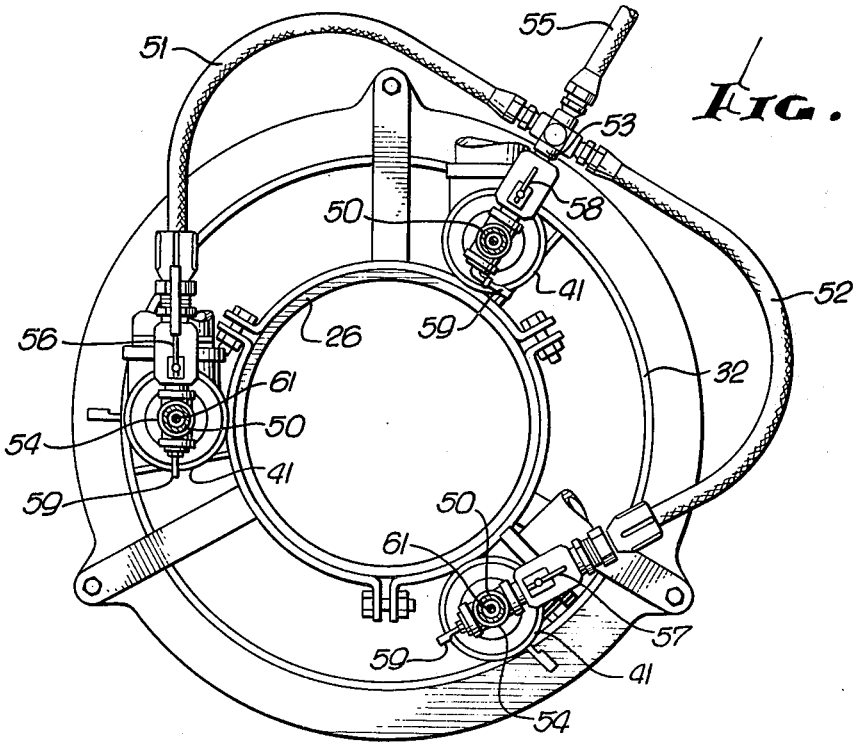
FIG. 4 is an end elevation on lines 4-4 of FIG. 1.

In accordance with an important aspect of the invention, multiple pipes or nozzles are spaced about the inner duct, such pipes opening forwardly to deliver fluid fuel to the burning zone beyond the ends of the pipes; further, the air delivery structure is oriented to deliver air to such fuel delivered from the pipes as well as from the inner duct. There are preferably at least two or more of such pipes spaced about the axis 40 of the inner duct, as for example fuel gas and air pipes 41. In FIG. 3 the pipes 41 are shown located adjacent radial spacers 42 which are integral with the inner duct and project outwardly within annulus 33 to center the inner duct within the outer duct. The pipes 41 project rearwardly of the central duct 26, as at 41*a* to connect with tees 142 to which manifold conducts 43–45 are connected, as better shown in FIG. 2. Such conducts are supplied from a source 46, and valves 47–49 are located in conducts 43–45 to control the amount of combustible gas and air supplied to pipes 41. The forwardly tapered outlets of the latter appear at 41*b* in FIG. 1, and also FIG. 5.

The pipes also include liquid fuel pipes 50 which are advantageously located coaxially within pipes 41, but have outer diameters substantially smaller than the inner diameter of pipes 41. The liquid fuel (oil) pipes 50 project rearwardly of the tees 142, as at 50*a*, and are supplied with fuel from branch manifold hoses 51–53, as via tees 54, and from a source hose 55. Control valves 56–58 are located in series with branches 51–53, and pressure gauges 59 are attached to the tees, as is clear from FIG. 4. Pipes 50 are centered within pipes 41 as by means of radial spacers 60 attached to pipes 50 and engageable with the bores of pipes 41. The forward ends of pipes 50 are internally threaded to receive nozzles 63 having forwardly exposed outlets 64.

Figure 1:
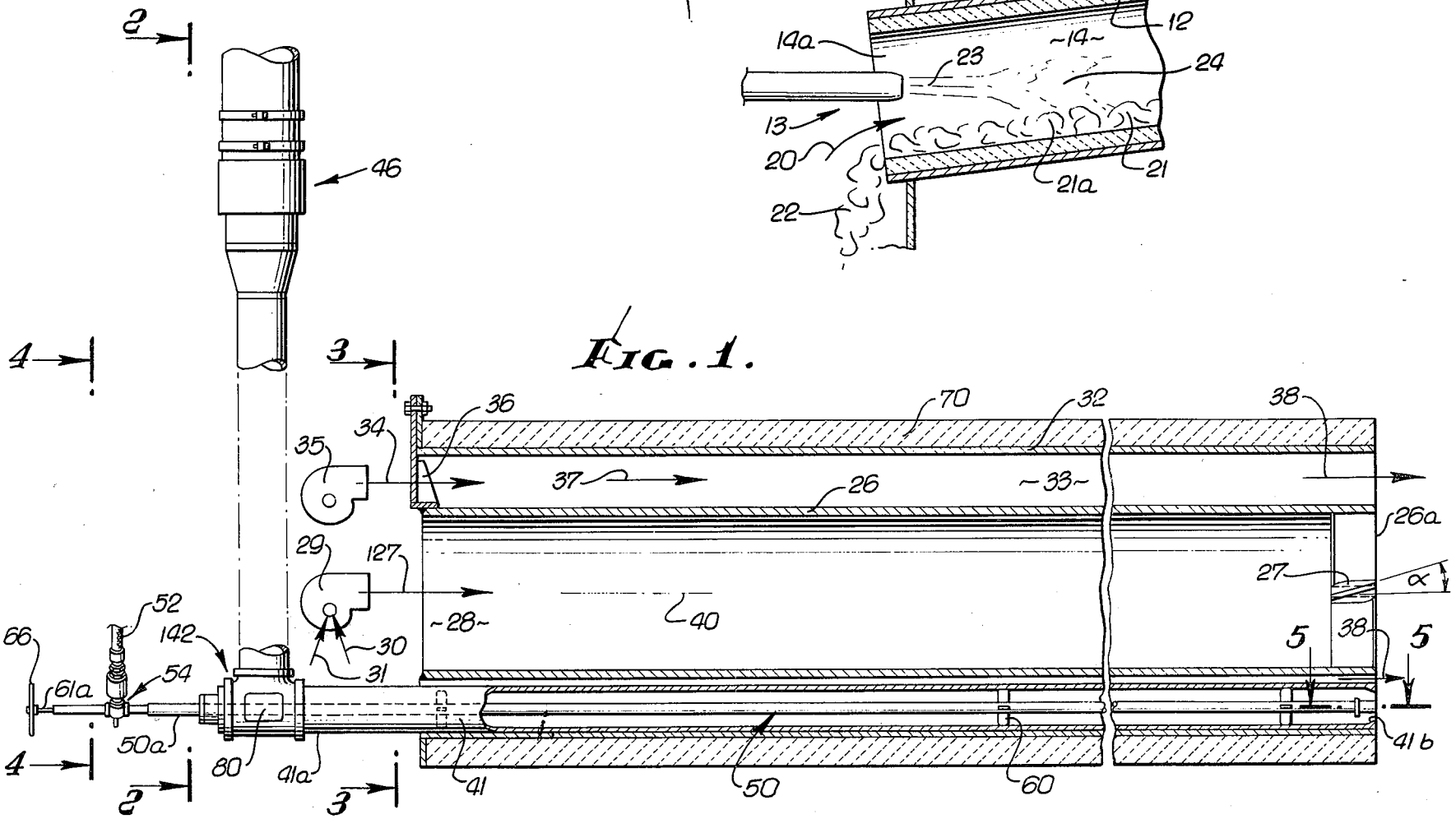
FIG. 1 is an elevation, taken in section through a burner assembly incorporating the invention.
Figure 2:
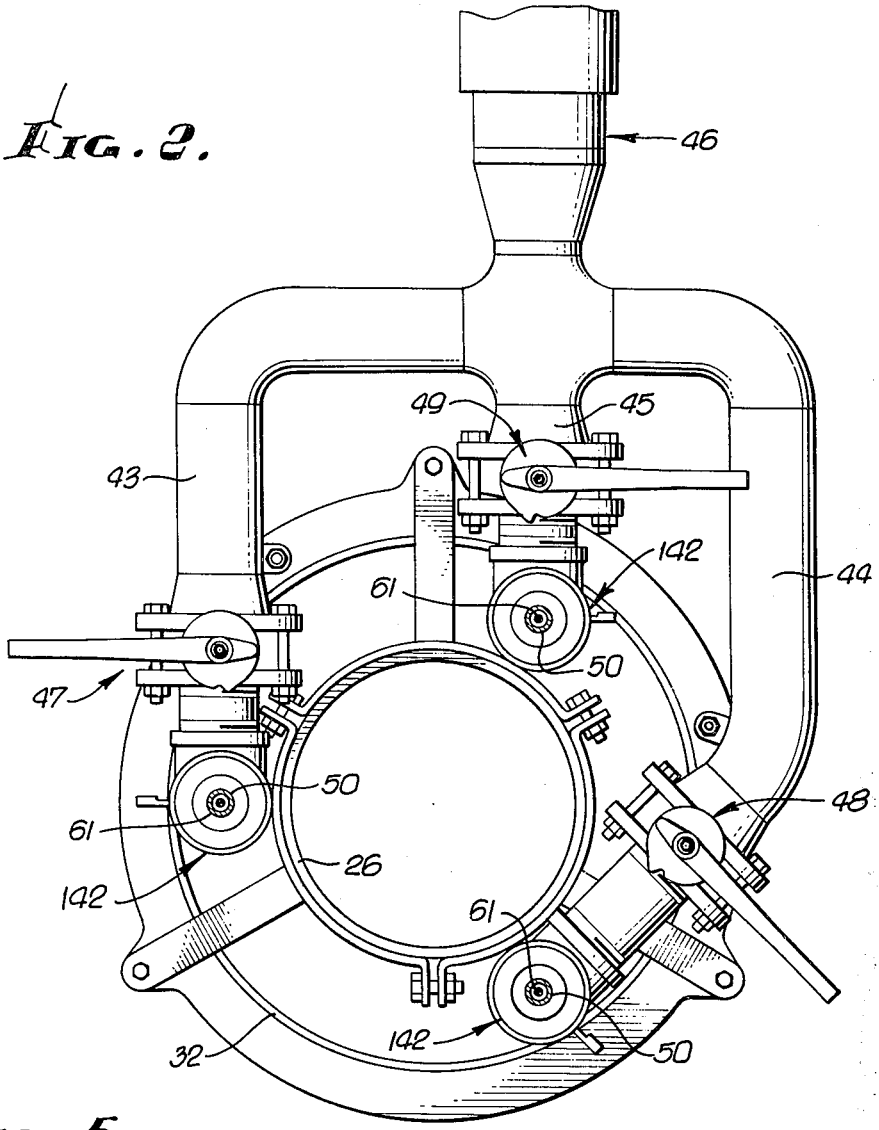
FIG. 2 is an end elevation on lines 2—2 of FIG. 1.
Figure 5:
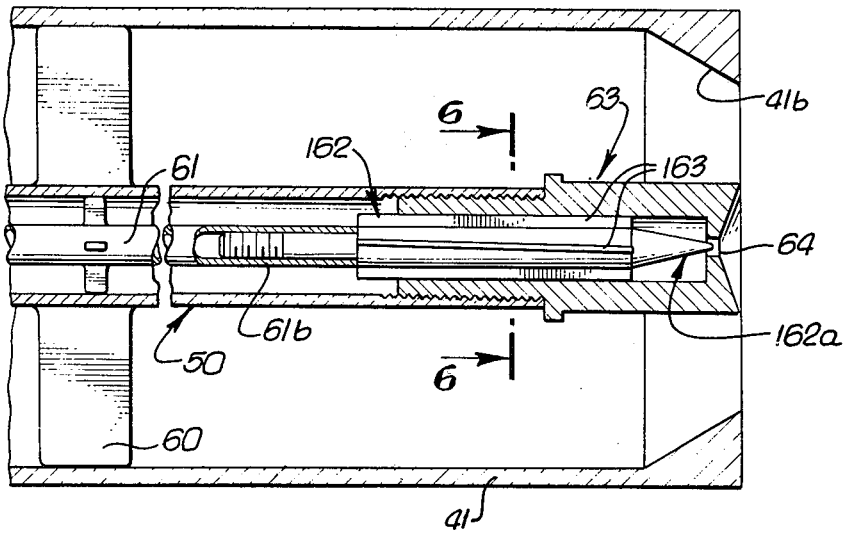
FIG. 5 is a fragmentary side elevation of the nozzle end portion of an oil pipe.
Figure 6:
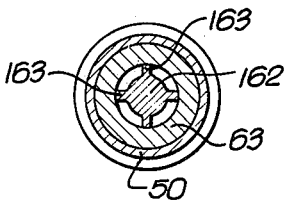
FIG. 6 is a section on lines 6-6 of FIG. 5.

Also shown in FIGS. 1, 5 and 6 are control rods 61 projecting forwardly within the liquid fuel pipes. The rods have internally threaded forward ends 61*b* carrying nozzle pins 162 with tapered forward ends 162*a* adjustably received within the nozzle orifices 64. Rotation of the rods controls metering of the pressurized and atomized outflow of liquid fuel. The flutes or flights 163 on the pins 162 within the nozzle cavities are typically slightly spiraled to impart swirl to the oil leaving the orifices, for flame structure shaping. The rods freely project rearwardly at 61*a* and are independently adjustably rotatable as by means of handles 66. Removal of side plugs 80 from tees 142 allows access to the rods for adjustment purposes.

The outer shell or duct 32 carries a closely surrounding cylinder of refractory material 70, as shown, to protect against intense heat from within the cement kiln.

Operation of the burner for solid and fluid fuels may be summarized by the following steps:

a. providing a central forwardly elongated zone for the forward delivery of the communicated solid fuel, and b. flowing the fluid fuel forwardly peripherally of the zone and jetting the fluid fuel forwardly (and preferably directed slightly toward the center line 40) from multiple locations toward a burn zone located forwardly of the solid fuel delivery zone, and c. confining air to flow forwardly peripherally of the solid fuel delivery zone, and toward the burn zone.

Further, the fluid fuel may include oil and/or gas and may be delivered as the sole feed source, or may be employed to ignite the solid fuel delivered from the inner duct to the burn zone, the fluid fuel penetrating into the solid fuel stream or extending adjacent thereto proximate the burn zone. After such ignition, the fluid fuel delivery may be decreased or terminated, whereby solid fuel particles alone support combustion. Various fuel delivery combinations may be achieved to control flame structure, position and intensity within the cement kiln.

In summary, the unusual advantages of the invention may be summarized as follows. The burner has the ability to burn multiple fuels such as coal, coke, oil and gas, with independent control of each so that one or more fuels may be burned at any time; petroleum coke and coal can be burned as a combined fuel after premixing; petroleum coke, having very low volatiles content, can be burned using the inner duct for its delivery along with primary air, and using one or more of the peripheral pipes or guns to deliver gas and/or oil for burning to ignite the solid fuel; switching of fuels can be accomplished without shutting off the burner, i.e. with flame retention, thereby eliminating thermal shock of the refractory lining of the rotary kiln, and obviating loss of production, fuel switching can be accomplished without removal of the burner from the kiln; natural gas can be used as the atomizing agent, instead of air, in case oil and gas are employed as the combined fuel; the fuels can be relatively adjusted to tailor the burn zone flame structure for optimum operation of the kiln; the shutters 36 can be adjusted to regulate the flow of ambient or hot air drawn through the annular area 33, the negative pressure in the kiln providing the force or draft draining the air through the area 33; the oil and gas outlets can be directed to cause the oil and gas flows to converge to penetrate the particulate solid fuel stream for fuel mixing; and the primary air flow to the fluid pipes can be adjusted to allow for flame position correction and for optimum combustion.

I claim:

1. In a multiple fuel burner assembly a. a forwardly elongated inner duct to deliver pulverized solid fuel to a burning zone beyond the end of the duct, b. multiple pipes including liquid fuel pipes and gaseous fuel pipes spaced about the inner duct and opening generally forwardly to deliver fluid fuel to said zone beyond the ends of said pipes, c. air delivery structure located outwardly of said inner duct and oriented to deliver air to the fuel delivered from said pipes and inner duct to said zone for combusting said fuel, d. pulverized solid fuel supply means directly communicating with said inner duct to deliver pulverized solid fuel thereto, and e. means to variably control the supply of liquid fuel and gaseous fuel via said liquid and gaseous fuel pipes.

2. The burner assembly of claim 1 wherein said air delivery structure comprises a forwardly elongated outer duct extending about said inner duct to form an air passing annulus within which said pipes extend forwardly.

3. The assembly of claim 1 including means communicating with said inner duct to deliver pulverized coke and/or coal thereto.

4. The assembly of claim 3 said means delivers a pulverized fuel entraining air stream to said inner duct.

5. The assembly of claim 1 including means communicating with said pipes to deliver combustible oil and/or gas thereto.

6. The assembly of claim 2 wherein there are at least two of said pipes spaced about said inner duct.

7. In a multiple fuel burner assembly a. a forwardly elongated inner duct to deliver pulverized solid fuel to a burning zone beyond the end of the duct, b. multiple pipes spaced about the inner duct and opening generally forwardly to deliver fluid fuel to said zone beyond the ends of said pipes, said pipes including liquid fuel pipes located within gaseous fuel pipes, and c. air delivery structure located outwardly of said inner duct and oriented to deliver air to the fuel delivered from said pipes and inner duct to said zone for combusting said fuel, said air delivery structure comprising a forwardly elongated outer duct extending about said inner duct to form an air passing annulus within which said pipes extend forwardly.

8. The assembly of claim 2 including means to control passage of combustion air forwardly in said annulus.

9. The assembly of claim 8 wherein said last named means comprise air shutter structure located proximate the rearward end of said inner duct.

10. The assembly of claim 2 including refractory material closely surrounding said center duct.

11. The assembly of claim 10 including a rotary kiln in which said burner assembly projects, said combustion zone located within said kiln.

12. The assembly of claim 11 wherein said kiln comprises a cement kiln, there being mean to deliver calcareous materials to said kiln for calcination and clinker formation therein.

13. In a multiple fuel burner assembly a. a forwardly elongated inner duct to deliver pulverized solid fuel to a burning zone beyond the end of the duct, b. multiple pipes including liquid and gaseous fuel pipes spaced about the inner duct and opening generally forwardly to deliver fuel to said zone beyond the ends of said pipes, c. air delivery structure located outwardly of said inner duct and oriented to deliver air to the fuel delivered from said pipes and inner duct to said zone for combusting said fuel, said air delivery structure comprising a forwardly elongated outer duct extending about said inner duct to form an air passing annulus within which said pipes extend forwardly, and d. control rods projecting forwardly within said liquid fuel pipes, the rods having adjustable forward terminals controlling the outflow of pressurized and atomized liquid fuel from nozzle outlets at the forward terminals of the liquid fuel pipes.

14. The method of operating a burner for solid and fluid fuels, the fluid fuels including liquid and gaseous fuels, the solid fuel being comminuted, that includes, a. provding a central forwardly elongated zone for the forward delivery of the comminuted solid fuel, b. flowing the fluid fuel including liquid fuel forwardly peripherally of said zone and jetting the fluid fuel forwardly from multiple locations toward a burn zone located forwardly of the solid fuel delivery zone, c. confining air to flow forwardly peripherally of said solid fuel delivery zone, and toward said burn zone, d. delivering the comminuted fuel forwardly within said delivery zone and jetting the solid fuel from the burner toward said burn zone to be ignited by flames produced upon combustion of the fluid fuel, and d. controlling the rate of delivery of liquid fuel in relation to the delivery of gaseous fuel.

15. The method of claim 14 including the step of thereafter substantially decreasing the forward jetting of said liquid fuel toward said burn zone.

16. The method of claim 14 wherein said gaseous fuel consists of combustible gas.

17. The method of claim 14 wherein said liquid fuel consists of combustible oil.

18. The method of claim 14 wherein the burner is located within a cement kiln operating to produce a draft drawing ambient air forwardly peripherally of the solid fuel delivery zone.

* * * * *